US006918140B1

(12) United States Patent
Cooper

(10) Patent No.: US 6,918,140 B1
(45) Date of Patent: Jul. 19, 2005

(54) PROTECTIVE FABRIC AND APPAREL SYSTEMS

(75) Inventor: Shane Kevin Cooper, Hickory, NC (US)

(73) Assignee: DeFeet International, Inc., Hildebran, NC (US)

( * ) Notice: Subject to any disclaimer, the term of this patent is extended or adjusted under 35 U.S.C. 154(b) by 11 days.

(21) Appl. No.: 10/403,722

(22) Filed: Mar. 31, 2003

Related U.S. Application Data

(60) Provisional application No. 60/368,877, filed on Mar. 29, 2002.

(51) Int. Cl.[7] ..... A41D 13/00

(52) U.S. Cl. ..... 2/228; 2/466

(58) Field of Search ..... 2/161.8, 168, 69, 2/400–406, 409, 239, 243.1, 467, 267, 227, 228, 214, 238, 237, 272, 466; 604/358, 378; 428/304.4; 442/76, 77, 86

(56) References Cited

U.S. PATENT DOCUMENTS

| | | | | | |
|---|---|---|---|---|---|
| 3,909,847 | A | * | 10/1975 | Holt et al. | 2/465 |
| 4,117,792 | A | * | 10/1978 | Navlyt | 112/433 |
| 4,811,427 | A | | 3/1989 | Regan | |
| 4,961,233 | A | | 10/1990 | Black | |
| 4,969,216 | A | * | 11/1990 | Guelli | 2/400 |
| 5,038,408 | A | * | 8/1991 | DeBaene | 2/23 |
| 5,068,920 | A | | 12/1991 | Bray | |
| 5,131,100 | A | | 7/1992 | Atwater et al. | |
| 5,136,727 | A | | 8/1992 | Brisco | |
| 5,201,074 | A | | 4/1993 | Dicker | |
| 5,271,101 | A | | 12/1993 | Speth et al. | |
| 5,291,617 | A | * | 3/1994 | Moretz et al. | 2/400 |
| 5,297,296 | A | | 3/1994 | Moretz et al. | |
| 5,385,036 | A | | 1/1995 | Spillane et al. | |
| 5,551,091 | A | * | 9/1996 | Tyndall | 2/227 |
| 5,598,586 | A | | 2/1997 | Munjone | |
| 5,649,328 | A | * | 7/1997 | Martin | 2/238 |
| 5,746,013 | A | | 5/1998 | Fay, Sr. | |
| 5,823,618 | A | | 10/1998 | Fox et al. | |
| 5,924,134 | A | * | 7/1999 | Taylor et al. | 2/81 |
| 5,978,970 | A | | 11/1999 | Bright | |
| 6,023,789 | A | | 2/2000 | Wilson et al. | |
| 6,041,437 | A | * | 3/2000 | Barker et al. | 2/82 |

(Continued)

FOREIGN PATENT DOCUMENTS

EP 1179302 A2 * 2/2002 ..... A41D/1/08

OTHER PUBLICATIONS

Faytex Corp. web site, www.faytex.com, available as of Mar. 31, 2003.

Worth Sports web site, www.worthsports.com/apparel/apparel.html, available as of Mar. 31, 2003.

* cited by examiner

*Primary Examiner*—Alissa L. Hoey
(74) *Attorney, Agent, or Firm*—Kilpatrick Stockton LLP

(57) ABSTRACT

A multi-layer protective fabric includes an inner layer, an middle layer, and an outer wicking layer. The outer fabric layer includes an inside layer of hydrophobic material, an outside layer of hydrophilic material, and an intermediate layer of hydrophobic monofilament yarns extending between and knitted together with the outside and inside layers, and promotes wicking of moisture from a wearer's skin to the outer layer. The multi-layer protective fabric middle layer includes a porous, cushioning material. The multi-layer protective fabric inner layer includes a cushioning, abrasion-resistant material, such as doeskin. Articles of apparel, for example cycling shorts, can include such a multi-layer protective fabric either alone or in combination with other moisture-managing, cushioning fabrics. Such protective fabric and apparel systems provide improved removal of moisture from skin, reduction of contact stress, and decrease in abrasion.

7 Claims, 3 Drawing Sheets

U.S. PATENT DOCUMENTS 6,041,441 A * 3/2000 Counts et al. ..... 2/227
6,061,829 A 5/2000 Gunn
6,393,618 B2 * 5/2002 Garneau ..... 2/228
6,401,250 B1 * 6/2002 McNabb ..... 2/78.2
6,511,927 B1 * 1/2003 Ellis et al. ..... 442/77
6,687,917 B2 * 2/2004 Forsyth et al. ..... 2/228
2003/0056282 A1 * 3/2003 Coccia ..... 2/466
2003/0226197 A1 * 12/2003 Cramer ..... 2/466
2004/0143890 A1 * 7/2004 Reschewtz ..... 2/466

PROTECTIVE FABRIC AND APPAREL SYSTEMS

CROSS-REFERENCE TO RELATED APPLICATIONS

This application claims priority to U.S. Provisional Patent Application No. 60/368,877, filed Mar. 29, 2002, which is incorporated by reference herein in its entirety.

FIELD OF THE INVENTION

The present invention relates to textile fabrics and, in particular, to combinations of fabrics useful for managing moisture and cushioning stress points in a wearer. Embodiments of the present invention are advantageous in fabrics and articles of apparel for removing moisture from skin, reducing contact stress, and decreasing abrasion.

BACKGROUND OF THE INVENTION

Different types of fabrics and apparel have been designed for support and moisture management in critical anatomical areas during, for example, athletic activities. One design includes an exercise short having a ventilating portion of light weight, permeable, open mesh, woven fabric made from cotton, polyester, nylon, and other fibers, allowing for rapid heat transfer from the pelvic region. Another athletic compression short includes a crotch panel formed of stretchable elastic, knit fabric in which the front of the crotch panel has an open mesh warp knit construction and the rear of the crotch panel has a plain warp knit construction. These types of athletic apparel are not particularly suitable for wear during very active sports in which an athlete may perspire excessively and create wet, perspiration-soaked clothing, which no longer offers the proper support to the skin and muscles of the wearer.

In addition, cushioning support has been designed into various types of athletic apparel. For example, cyclists often wear specially designed cycling pants that have cushioning between the seat and the cyclist, that are designed for minimum chaffing of the cyclist and minimum wind resistance, and that are constructed for durability. One type of conventional cycling shorts generally have a four, six, or eight panel construction, elastic ribbing around the bottom of the leg openings and the waist, and additional padding disposed in the buttocks and crotch regions termed a "chamois." The chamois is formed from various materials which are stitched or laminated together into layers to provide increased protection to the cyclist. Such materials and layered constructions are designed to distribute and dissipate the pressure, shock, and vibration transmitted by a bicycle seat. Such cycling pants typically include a padded liner, or crotch protector, which is located in the crotch and buttocks regions, which transfers the force exerted on a rider's crotch by a bicycle seat laterally away from the perineal area to the lower buttocks. In addition, multi-ply chamois designs can be cut to fit between the legs of a cyclist.

Other conventional cycling shorts include various seat pad materials and constructions to add cushioning support to a cyclist's seat area. For example, one seat pad in cycling shorts has a fluid layer. Another cycling shorts design includes rear and frontal pockets containing resilient pads. In another design, a single-piece chamois of seam-free fabric is heat-formed to impart a generally form-fitting shape to the cycling shorts seat area. In yet another design, an anatomical seat pad has "break lines" positioned to conform a seat pad liner to the anatomical profile of a cyclist positioned in a riding position on a bicycle. However, such approaches to padding have not combined moisture-management materials to remove moisture away from a cyclist's skin in the seat area. As a result, moisture can build up inside conventional cycling shorts, increasing the risk of chaffing and/or blisters to a cyclist.

Other materials have been used in an attempt to provide cushioning support in cycling shorts. One such material is polyurethane foam, layers of which can be combined to form a padding. For example, one cycling shorts construction combines a two-layer chamois and layers of polyurethane foam, terry cloth, or fleece. Another material used in cycling shorts is a synthetic suede material. A particular cycling shorts design includes a heat-formed chamois made from a laminate of synthetic leather and a knitted polyester fleece which are bonded together by an adhesive. However, the stiffness of foam padding layers and/or a multi-ply construction are not conducive to providing a comfortable, anatomically-conforming fit. Moreover, when such conventional materials are heat molded together, an anatomically conforming chamois is achieved for the one position for which the chamois is molded. When the cyclist moves to other positions, however, the material provides less than a conforming fit.

Thus, there is a need to provide a protective fabric system that combines moisture-managing fabrics and fabrics that provide cushioning to selected parts of a wearer's body.

There is also a need to provide articles of apparel adapted for removing moisture from skin, reducing contact stress, and decreasing abrasion in selected regions, for example, in athletic apparel.

In particular, there is a need to provide a cycling bib-short combination that manages moisture in selected regions, provides cushioning, and that is flexible, form-fitting, and comfortable during use.

SUMMARY OF THE INVENTION

The present invention provides a multi-layer protective fabric system and apparel utilizing such a fabric system that remove moisture from skin, reduce contact stress, and decrease abrasion. Embodiments of the present invention include a multi-layer protective fabric system in combination with other moisture-managing, cushioning fabrics. Embodiments include such fabric systems adapted to manage moisture and cushion anatomical stress points of a wearer, for example, in a bib-short athletic garment useful for cyclists. Other embodiments include methods of producing such multi-layer protective fabric systems and apparel.

Embodiments of a multi-layer protective fabric system of the present invention include an inner layer, a middle layer, and an outer layer. In embodiments, the outer layer comprises an outer wicking fabric layer that includes a three zone moisture management system. The outer wicking fabric layer includes an inside layer of hydrophobic material, an outside layer of hydrophilic material, and monofilament yarns of hydrophobic material extending between and knitted together with the outside and inside layers. The term "hydrophilic" is defined as having an affinity for water, or moisture-absorbing. The term "hydrophobic" is defined as lacking affinity for water, or moisture-repelling. Embodiments of an outer wicking fabric layer of the present invention include strands of wicking fibers, for example, hydrophobic monofilament yarns extending between the inside and outside layers. The monofilament yarns decrease contact, and thus reduce friction, between the inside and outside layers.

Such a three zone construction creates an air chamber between the layers that provides permeability to air and facilitates air circulation that promotes ventilation and cools the skin underneath, helps evaporate moisture, and keeps the skin dry. The inside layer, located toward the skin of a wearer, and the monofilament yarns intermediate the layers, both being moisture repelling, pass the moisture vapor, as well as heat, through the air chamber to the outside layer of moisture-absorbing material. The hydrophilic outside layer absorbs the transferred moisture and passes it through to the outer surface of the outside layer where the moisture evaporates in the surrounding atmosphere. Such a multi-layer, outer wicking fabric construction having an integral air chamber avoids the need for a cushioning foam layer in which moisture can collect, leading to bacterial growth and possible infection.

The inside layer of the outer wicking fabric comprises a knit layer of hydrophobic material such as a polyester. In embodiments, the inside layer comprises Hydrofil® nylon, a hydrophobic material available from Honeywell, Inc. Polyester comprising the inside layer may have a yarn fineness of about 40–150 denier. The inside knit layer may be textured or plain. The outside layer comprises a knit layer of hydrophilic material such as nylon. The nylon comprising the outside layer has a yarn fineness of about 90 denier.

In embodiments, the inside knit layer is spaced from the outside layer a predetermined distance to form an air chamber between the layers. The inside and outside layers are maintained in their spaced apart relationship by monofilament yarns which extend between and are knitted together with the inside and outside knit layers in a substantially perpendicular fashion. The intermediate monofilament layer can be knit in various manners, for example, in a warp knit raschel pattern or in a warp knit tricot pattern. In embodiments, the monofilament yarns comprise hydrophobic material such as polyester. The polyester comprising the monofilament yarns may have a yarn fineness of about 30 denier.

In embodiments including such a composite multi-layer protective fabric, moisture, including perspiration, is wicked away from a wearer's skin to the outer surface of the fabric outside layer. As a result, and in combination with air circulation in the air chamber where the transferred moisture is exposed to an increased volume of air more quickly, the moisture is more readily evaporated than in conventional moisture-managing fabrics. This increased reduction in moisture dries the skin underneath more efficiently and effectively, which decreases friction between the skin and the fabric and diminishes the likelihood of blister formation.

The outside layer of the outer wicking fabric of the multi-layer protective fabric can be knit in an open mesh design, which further enhances air circulation and moisture evaporation. In addition, an open mesh design provides a cool, breathable appearance.

In embodiments, the inner layer of the composite multi-layer protective fabric comprises a material that provides cushioning and that has a low coefficient of friction and high resistance to abrasion. In embodiments, the inner layer is a doeskin material. A coefficient of friction is defined as the ratio of the weight of an object being moved along a surface and the force that maintains contact between the object and the surface. A low friction coefficient doeskin inner layer moves easily against a wearer's skin with a minimum of resistance, thus reducing the risk of abrasion during movement.

In embodiments, the middle layer of the composite multi-layer protective fabric comprises a porous material that provides cushioning. Each layer of the composite multi-layer protective fabric provides cushioning, decreases friction and stress against a wearer's skin, and reduces abrasion individually and in a cumulative manner when used in combination.

The outer, middle, and inner layers of the composite multi-layer protective fabric are engaged with each other. The layers may be bonded together, such as with conventional laminating or thermobonding techniques. With each layer engaged with the adjacent layer in such a manner, there is no movement between the respective layers, so as to keep the coefficient of friction between the material and skin low.

Embodiments of the composite multi-layer protective material of the present invention can be combined with various other moisture-managing materials in apparel, sporting goods, medical appliances, and in other applications to provide a total moisture management system garment. One such other moisture-managing material utilizes a single layer of moisture-wicking fibers. Another moisture-managing material that can be combined with the composite multi-layer protective fabric in embodiments of the present invention comprises two layers, an inner hydrophobic layer to be placed next to a wearer's skin and a hydrophilic layer, such as nylon, as the outer layer. For example, one such a bi-layer moisture-managing material includes an inner layer of hydrophobic fibers and an outer layer of Hydrofil® nylon to provide increased moisture vapor transport away from a wearer's skin. The outer hydrophobic layer may comprise a nylon and polyester blend.

Embodiments of the present invention include a shorts garment including a shorts first fabric portion comprising a multi-layer protective fabric having an hour-glass shape extending from the front torso region through the crotch region to the back torso region of the shorts garment. In other embodiments, such a shorts garment includes a shorts second fabric portion sewn to the shorts first fabric portion extending from the waist downward to cover the majority of an inner thigh region and laterally to a midline of each leg in the front and back. The shorts garment can also include a shorts third fabric portion sewn to the shorts second fabric portion and extending from the waist to a bottom of the legs and from the shorts second fabric portion laterally around each side to join the shorts second fabric portion in both the front and back of each leg. The shorts second and third fabric portions can include spandex.

Embodiments of the present invention include a bib-shorts garment having a bib portion with a bib first fabric portion located in the shoulder straps and extending from a mid-clavicular line on each side in the front of the bib portion along each side and around the back. The bib first fabric portion includes an inner layer of hydrophobic fibers and an outer layer of hydrophilic fibers to promote moisture transport away from a wearer's skin. The bib portion can include a bib second fabric portion extending inside the mid-clavicular line on a left and a right of the front from the neck area to the bottom of the bib portion comprising a double-layer material having an inner layer of hydrophobic fibers and an outer layer of hydrophilic fibers.

Embodiments of the present invention include methods for producing a multi-layer protective fabric system and apparel utilizing such a fabric system having enhanced moisture-management and cushioning properties. For example, one such method includes weaving or knitting an inside layer of hydrophobic fibers and an outside layer of hydrophilic fibers, joining the inside layer and outside layer with perpendicularly oriented hydrophobic filaments between the layers to create an interstitial air space in a moisture-wicking fabric. The method can further include bonding the moisture-wicking fabric as an outer layer to middle and inner layers of cushioning and abrasion-resistant materials to achieve a composite multi-layer protective fabric. In other embodiments, a method of the present invention includes combining such a multi-layer protective fabric with other moisture-managing materials in an article of apparel. Other embodiments of a method include producing a bib-short athletic garment including a multi-layer protective fabric of the present invention useful for providing moisture management and cushioning for cyclists.

Features of a multi-layer protective fabric system and apparel of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A multi-layer protective fabric system and/or apparel of the present invention provide numerous advantages over prior fabrics and apparel. For example, the present invention advantageously provides a protective fabric including an outer wicking fabric layer having a hydrophobic inside layer and a hydrophilic outside layer joined by hydrophobic filaments to create an air chamber, that effectively wicks moisture away from a wearer's skin and dries the skin. Such a protective fabric provides the advantage of increased air circulation that facilitates more rapid drying of the fabric and skin.

Another advantage is that the present invention provides a composite multi-layer protective fabric that includes cushioning materials that provide a low coefficient of friction, protect against impact stress, and decrease the chance of blister formation.

Another advantage is that the present invention provides moisture management and padding protection by combining a multi-layer protective fabric with a variety of other protective fabrics. Such moisture management and padding protection can be beneficially combined in articles of apparel.

Another advantage is that the present invention utilizes combinations of conventional fabrics to achieve more efficient and effective skin protection through moisture management and cushioning than when the individual fabrics are used alone.

Yet another advantage is that in embodiments wherein the seat area of an article of apparel includes a multi-layer protective fabric, the present invention includes a seamless seat, which further reduces abrasion and protects skin integrity. Such protective materials in the seat area also significantly reduce the likelihood of snagging fabric in the seat area on a piece of equipment.

The present invention advantageously provides a multi-layer protective fabric system and apparel which, by combining various known fabrics, are simple and inexpensive to manufacture.

Embodiments of the present invention advantageously provide an article of apparel including a protective multi-layer fabric system, in which the article of apparel has a correct anatomical fit for better comfort to a cyclist.

Still another advantage is that embodiments of the present invention can be utilized in a variety of configurations and applications. For example, multi-layer protective fabrics of the present invention can be effectively used on shins, knees, under arms, and in other anatomical areas susceptible to friction, abrasion, and moisture build-up related to activities in connection with which particular apparel is used. Embodiments can be used for safety applications in industrial settings. Embodiments can be used in medical applications, such as with orthopedic braces. Such protective fabrics and apparel can be used in sporting goods applications where moisture management and air flow are needed, for example, in wrestling uniforms, hockey uniforms, in shoulder pads, elbow pads, shin pads, and helmets. Such materials can be used in backpacks where moisture control and cushioning of contents, such as electronic equipment, is important. Moisture-managing and cushioning materials of the present invention can be used in footwear, including athletic footwear and work boots. Embodiments of the present invention also provide the benefit of a "technical" aesthetic appeal.

As will be realized by those of skill in the art, many different embodiments of a multi-layer protective fabric system and apparel according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

Embodiments of the present invention provide a multi-layer protective fabric system and apparel incorporating such a system. Such embodiments are advantageous for removing moisture from a wearer's skin, reducing contact stress with the skin, and decreasing abrasion. FIGS. 1–4 show aspects of such embodiments. Referring to the embodiment in FIG. 1, a multi-layer protective fabric 10 of the present invention includes three layers. An inner layer 20 comprises an abrasion-resistant material having a low friction coefficient. A middle layer 30 comprises a porous, cushioning material. An outer wicking layer 40 is adapted for wicking moisture away from a wearer's skin. The protective fabric 10 cushions a wearer's skin, removes moisture from the skin, and reduces stress to the skin.

Figure 2:
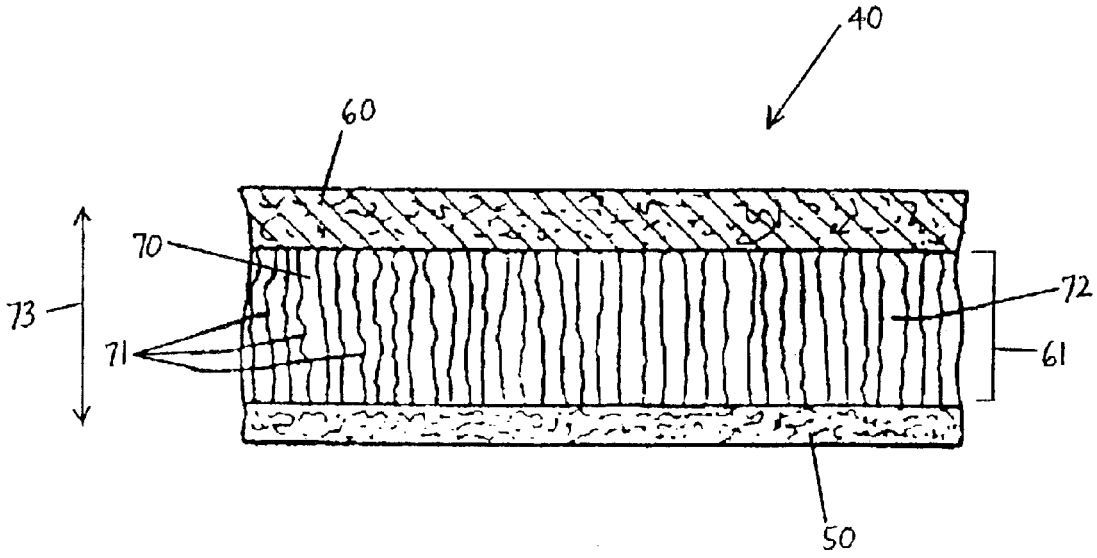
FIG. 2 is a cross-sectional view of the outer wicking layer in FIG. 1, showing an inside hydrophobic layer and an outside hydrophilic layer joined by an intermediate layer of hydrophobic monofilament yarns in an embodiment of the present invention.

The outer wicking layer 40, as shown in FIG. 2, includes three layers. An inside layer 50 contains hydrophobic material. An outside layer 60 contains hydrophilic material spaced apart a predetermined distance 61 from the inside layer 50. An intermediate layer 70 includes monofilament hydrophobic yarns 71. The hydrophobic yarns 71 are attached to and extend the predetermined distance 61 between the inside layer 50 and the outside layer 60. The resulting space between the inside and outside layers 50, 60, respectively, define a ventilation chamber 72. The term "hydrophilic" is defined as having an affinity for water, or moisture-absorbing. The term "hydrophobic" is defined as lacking affinity for water, or moisture-repelling. In this three zone moisture management system, moisture and heat are transferred from the wearer's skin by the inside layer 50 and the intermediate layer 70 to the outside layer 60 where the moisture and heat are transferred to the atmosphere.

The inside layer 50 of the outer wicking layer 40 can be knit using conventional machinery and techniques. The inside layer 50 can be made from polyester, nylon, or another suitable hydrophobic yarn. For example, the inside layer 50 can include Hydrofil® nylon, a hydrophobic material available from Honeywell, Inc. In preferred embodiments, the inside layer 50 yarns have a denier in the range of 40–150. In some embodiments, yarns of the inside layer 50 are textured.

The outside layer 60 of the outer wicking layer 40 can be knit using conventional machinery and techniques. The outside layer 60 can be made from nylon or another suitable hydrophilic yarn. In preferred embodiments, the knitted material of the outside layer 60 is an open mesh design, which further enhances air circulation and moisture evaporation. In addition, an open mesh design provides a cool, breathable appearance. In preferred embodiments, the outside layer 60 yarns have a denier of about 90. In some embodiments, yarns of the outside layer 60 are textured.

Figure 1:
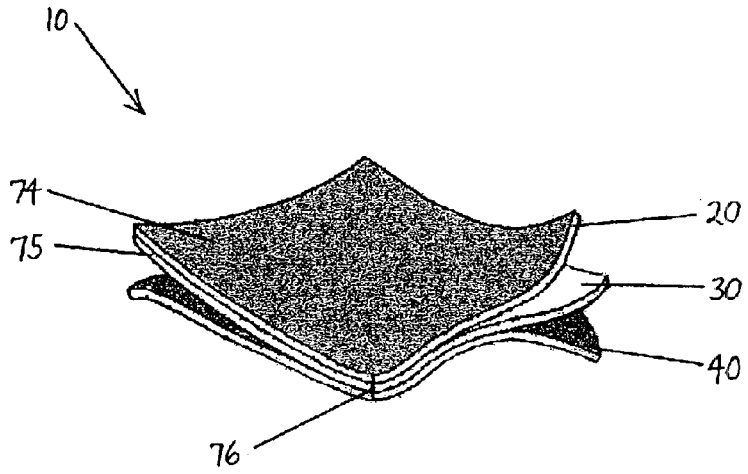
FIG. 1 is a perspective view of the inner, middle, and outer wicking layers in a moisture-managing, cushioning material in an embodiment of the present invention.

In the embodiment in FIG. 1, the intermediate layer 70 of monofilament hydrophobic yarns 71 are polyester yarns. In preferred embodiments, the intermediate layer 70 yarns 71 have a denier of about 30. As shown in FIG. 1, the inside layer 50 and the outside layer 60 are each knit in the same plane. The intermediate layer 70 yarns 71 are knit in the same plane as, and are substantially perpendicular to, the inside layer 50 and the outside layer 60. In this manner, the intermediate layer 70 provides the ventilation chamber 72 containing moisture-wicking fibers between the inside layer 50 and the outside layer 60. As a result, contact and friction between the layers 50, 60 are reduced. Moreover, the ventilation chamber 72 between the layers 50, 60 provides permeability to air and facilitates air circulation within and through the multi-layer protective fabric 10. Moisture transferred from the wearer's skin through the inside layer 50 to the intermediate layer 70 is exposed to an increased volume of air more quickly and is more readily evaporated than in conventional moisture-managing fabrics. This increased reduction in moisture dries the skin underneath more efficiently and effectively, which decreases friction between the skin and the fabric and diminishes the likelihood of blister formation.

The inside layer 50, located toward the skin of a wearer, and the intermediate layer 70 of monofilament yarns 71, both being moisture repelling, pass the moisture, as well as heat, through the ventilation chamber 72 to the outside layer 60 of moisture-absorbing material. The outside layer 60 absorbs the transferred moisture and passes it through to the outer surface of the outside layer 60 where the moisture evaporates in the surrounding atmosphere.

In embodiments, the intermediate layer 70 yarns 71 are knit as a warp knit raschel fabric. Alternatively, the intermediate layer 70 yarns 71 are knit as a warp knit tricot fabric.

Such an outer wicking fabric (40) is described in U.S. Pat. No. 5,746,013, issued to Fay, and can be obtained under the name "Aero-Spacer®" from Faytex Corporation at 185 Libbey Parkway, Weymouth, Mass. Such a fabric (40) having wicking properties and a ventilation chamber 72 avoids the need for cushioning foam that can collect moisture in which bacteria can grow and cause undesirable odors and possibly infections. Instead, embodiments of an outer wicking fabric layer 40 of the present invention utilize strands of hydrophobic wicking yarns 71 between the inside and outside layers 50, 60, respectively, that decrease contact, and thus reduce friction, between the layers 50, 60.

In preferred embodiments of the present invention, the inner layer 20 of the multi-layer protective fabric 10 includes a doeskin material 74. In preferred embodiments, the middle layer 30 of the multi-layer protective fabric 10 includes a laminate 75 of mesh fabric and foam. An example of such a porous, cushioning material that combines a mesh fabric and foam into a laminate is "Ban-O-Dor®," available from Faytex Corp. In embodiments of the present invention, each layer of the multi-layer protective fabric 10 provides cushioning, decreases friction and stress against a wearer's skin, and reduces abrasion individually and in a cumulative manner when used in combination.

In embodiments, the outer, middle, and inner layers 20, 30, 40, respectively, are bonded (76) with each adjacent layer so that there is no movement between the respective layers.

In embodiments, a moisture-managing underlayer (not shown) is disposed under the inner layer 20 of the multi-layer protective fabric 10. The underlayer is placed next to the wearer's skin, such that moisture is wicked away from the wearer's skin and friction between the skin and the protective fabric is reduced. The underlayer can include a single layer of moisture-wicking fibers. Alternatively, the underlayer can include a double layer of moisture-wicking fibers, in which an inner hydrophobic layer is disposed for placement next to the wearer's skin and an outer hydrophilic layer is placed on top of the underlayer inner layer adjacent to the inner layer 20 of the multi-layer protective fabric 10.

An example of a double layer moisture-wicking material is Fantasia®, available from Faytex Corp. Fantasia® is a lightweight pique fabric that combines an inner layer of hydrophobic fibers and an outer layer of Hydrofil® nylon to provide increased moisture transport away from a wearer's skin. The outer hydrophilic layer may comprise a nylon and polyester blend. Fantasias material may include an inner layer of DuPont's CoolMax® fibers and an outer layer of Hydrofil® nylon, and may also include spandex for increased elasticity.

Such a multi-layer protective fabric 10 providing moisture management and padding protection can be utilized in a variety of configurations and applications. For example, a multi-layer protective fabric 10 of the present invention can be effectively used on shins, knees, under arms, and in other anatomical areas susceptible to friction, abrasion, and moisture build-up related to activities in connection with which particular apparel is used. Embodiments can be used for safety applications in industrial settings. Embodiments can be used in medical applications, such as with orthopedic braces.

Embodiments of a multi-layer protective fabric 10 can be used in sporting goods applications where moisture management and air flow are critical, for example, in hockey uniforms, in shoulder pads, elbow pads, shin pads, and helmets. Such a multi-layer protective fabric 10 can be used in backpacks where moisture control and cushioning of contents, such as electronic equipment, is important. A cushioning and moisture-wicking multi-layer protective fabric 10 of the present invention can be used in footwear, including athletic footwear and work boots. Embodiments of the present invention also provide the benefit of a "technical" aesthetic appeal. Embodiments of the present invention can be combined with conventional fabrics to achieve more efficient and effective skin protection through moisture management and cushioning.

In embodiments of the present invention, an article of apparel includes a multi-layer protective fabric 10, as shown in FIG. 1. The multi-layer protective fabric 10 includes three layers. An inner layer 20 comprises an abrasion-resistant material having a low friction coefficient. A middle layer 30 comprises a porous, cushioning material. An outer wicking layer 40 is adapted for wicking moisture away from a wearer's skin. The protective fabric 10 cushions a wearer's skin, removes moisture from the skin, and reduces stress to the skin.

The outer wicking layer 40, as shown in FIG. 2, includes three layers. An inside layer 50 contains hydrophobic material. An outside layer 60 contains hydrophilic material spaced apart a predetermined distance 61 from the inside layer 50. An intermediate layer 70 includes monofilament hydrophobic yarns 71. The hydrophobic yarns 71 are attached to and extend the predetermined distance 61 between the inside layer 50 and the outside layer 60. In particular embodiments, the inside layer 50 and the outside layer 60 are each knit in a plane, and the intermediate layer 70 yarns 71 are knit in the same plane and are substantially perpendicular to the inside layer 50 and the outside layer 60. The resulting space between the inside and outside layers 50, 60, respectively, define a ventilation chamber 72. In this three zone moisture management system, moisture and heat are transferred from the wearer's skin by the inside layer 50 and the intermediate layer 70 to the outside layer 60 where the moisture and heat are transferred to the atmosphere.

In embodiments of an article of apparel, the inner layer 20 comprises a doeskin material 74. The middle layer 30 comprises a laminate 75 of mesh fabric and foam. The outer, middle, and inner layers 20, 30, 40, respectively, are bonded with each adjacent layer so that there is no movement between the respective layers.

In the present invention, an article of apparel can include an article of athletic apparel, an article of industrial clothing, footwear, and/or a medical appliance.

Figure 3:
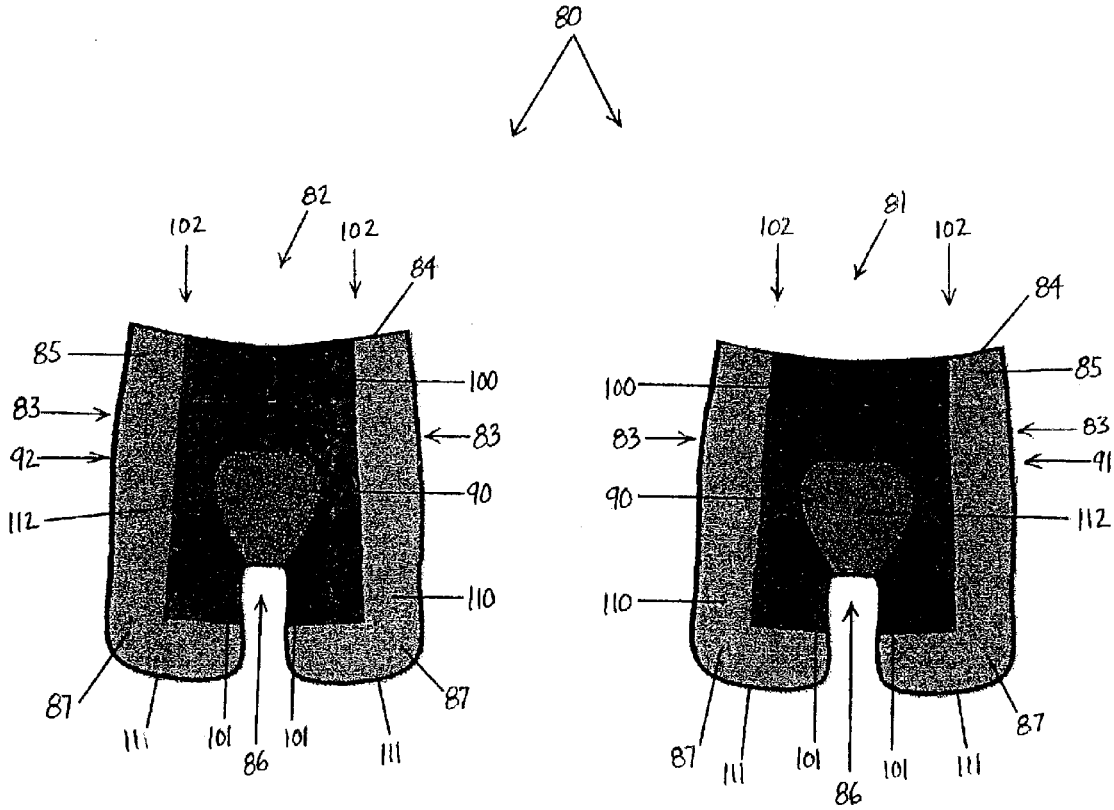
FIG. 3 is a view of the front and back of a bib-short garment including a multi-layer protective fabric having moisture-management and cushioning properties in the crotch area of the shorts in an embodiment of the present invention.

As shown in the embodiment in FIG. 3, an article of apparel includes a shorts garment 80 having a front 81, a back 82, two sides 83, a waist 84, a torso region 85, a crotch region 86, and two legs 87 extending from the torso region 85. The shorts garment 80 includes a shorts first fabric portion 90 comprising a multi-layer protective fabric 10 having an hour-glass shape extending from a middle 91 of the front 81 torso region 85 through the crotch region 86 to a middle 92 of the back 82 torso region 85. This arrangement provides for a reduction in moisture that dries the skin in the crotch region more efficiently and effectively, which decreases friction between the skin and the multi-layer protective fabric 10 and diminishes the likelihood of blister formation in the areas coming into contact with a seating surface.

In the shorts garment 80, the multi-layer protective fabric 10 further includes three layers. An inner layer 20 comprises an abrasion-resistant material having a low friction coefficient. A middle layer 30 comprises a porous, cushioning material. An outer wicking layer 40 is adapted for wicking moisture away from a wearer's skin. The protective fabric 10 cushions a wearer's skin, removes moisture from the skin, and reduces stress to the skin.

The outer wicking layer 40, as shown in FIG. 2, includes three layers. An inside layer 50 contains hydrophobic material. An outside layer 60 contains hydrophilic material spaced apart a predetermined distance 61 from the inside layer 50. An intermediate layer 70 includes monofilament hydrophobic yarns 71. The hydrophobic yarns 71 are attached to and extend the predetermined distance 61 between the inside layer 50 and the outside layer 60. In particular embodiments, the inside layer 50 and the outside layer 60 are each knit in a plane, and the intermediate layer 70 yarns 71 are knit in the same plane and are substantially perpendicular to the inside layer 50 and the outside layer 60. The resulting space between the inside and outside layers 50, 60, respectively, define a ventilation chamber 72. In this three zone moisture management system, moisture and heat are transferred from the wearer'skin by the inside layer 50 and the intermediate layer 70 to the outside layer 60 where the moisture and heat are transferred to the atmosphere.

In embodiments of the shorts garment 80, the inner layer 20 comprises a doeskin material 74, as shown in FIG. 1. The middle layer 30 comprises a laminate 75 of mesh fabric and foam. The outer, middle, and inner layers 20, 30, 40, respectively, are bonded with each adjacent layer so that there is no movement between the respective layers.

As shown in FIG. 3, the shorts garment 80 further includes a shorts second fabric portion 100 sewn to the shorts second fabric portion 90 extending from the waist 84 downward to cover the majority of an inner thigh region 101 and laterally to a midline 102 of each leg 87 in the front 81 and back 82. A shorts third fabric portion 110 is sewn to the shorts second fabric portion 90 extending from the waist 84 to a bottom 111 of the legs 87 and from the shorts second fabric portion 100 laterally around the each side 83 to join the shorts second fabric portion 100 in both the front 81 and back 82 of each leg 87. The shorts second fabric portion 100 and shorts third fabric portion 110 can include spandex. In preferred embodiments, the spandex in the shorts third fabric portion 110 is a heavier denier than the spandex in the shorts second fabric portion 100.

In embodiments of a shorts garment 80 of the present invention, the first, second, and third shorts portions 90, 100, 110, respectively, are sewn together with over-edged seams and are pressed flat to minimize seam friction against the wearer's skin. Preferably, the shorts first fabric portion 90 is seamless in a bicycle seat contact region 112, as shown in FIG. 3. A shorts garment 80 of the present invention provides a correct anatomical fit for better comfort to, for example, a cyclist.

Figure 4:
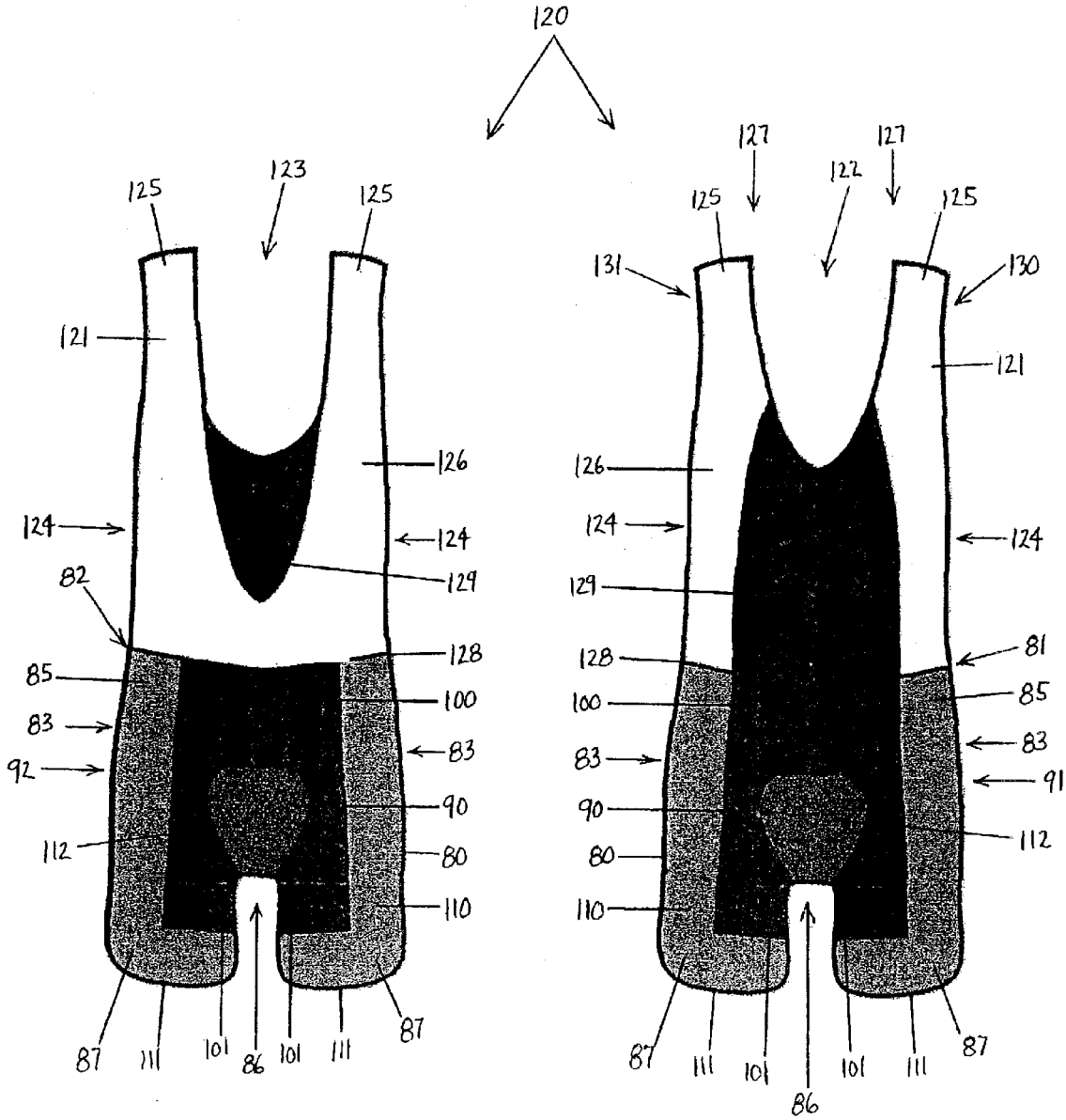
FIG. 4 is a view of the front and back of a bib-short garment including a multi-layer protective fabric having moisture-management and cushioning properties in the crotch area of the shorts and lightweight moisture-managing material in the bib in an embodiment of the present invention.

In another embodiment of the present invention, as shown in FIG. 4, a bib-shorts garment 120 includes a bib portion 121 having a front 122, a low-cut back 123, two sides 124, and two shoulder straps 125. The bib-shorts garment 120 includes a bib first fabric portion 126 located in the shoulder straps 125 and extending from a mid-clavicular line 127 on each side 124 in the front 122 of the bib portion 121 along each side 124 and around the back 123. The bib first fabric portion 126 includes an inner layer of hydrophobic fibers and an outer layer of hydrophilic fibers to promote moisture transport away from a wearer's skin.

The bib-shorts garment 120 includes a shorts garment portion 80 is that permanently attached to the bib portion 120. The shorts portion 80 has a front 81, a back 82, two sides 83, a waistline 128, a torso region 85, a crotch region 86, and two legs 87 extending from the torso region 85. A shorts first fabric portion 90 comprises a multi-layer protective fabric 10 having an hour-glass shape extending from a middle 91 of the front 81 torso region 85 through the crotch region 86 to a middle 92 of the back 82 torso region 85. This arrangement provides for a reduction in moisture that dries the skin in the crotch region more efficiently and effectively, which decreases friction between the skin and the multi-layer protective fabric 10 and diminishes the likelihood of blister formation in the areas coming into contact with a seating surface.

In the shorts garment portion 80 of the bib-shorts garment 120, the multi-layer protective fabric 10 further includes three layers. An inner layer 20 comprises an abrasion-resistant material having a low friction coefficient. A middle layer 30 comprises a porous, cushioning material. An outer wicking layer 40 is adapted for wicking moisture away from a wearer's skin. The protective fabric 10 cushions a wearer's skin, removes moisture from the skin, and reduces stress to the skin.

The outer wicking layer 40, as shown in FIG. 2, includes three layers. An inside layer 50 contains hydrophobic material. An outside layer 60 contains hydrophilic material spaced apart a predetermined distance 61 from the inside layer 50. An intermediate layer 70 includes monofilament hydrophobic yarns 71. The hydrophobic yarns 71 are attached to and extend the predetermined distance 61 between the inside layer 50 and the outside layer 60. In particular embodiments, the inside layer 50 and the outside layer 60 are each knit in a plane, and the intermediate layer 70 yarns 71 are knit in the same plane and are substantially perpendicular to the inside layer 50 and the outside layer 60. The resulting space between the inside and outside layers 50, 60, respectively, define a ventilation chamber 72. In this three zone moisture management system, moisture and heat are transferred from the wearer's skin by the inside layer 50 and the intermediate layer 70 to the outside layer 60 where the moisture and heat are transferred to the atmosphere.

In embodiments of the bib-shorts garment 120, the inner layer 20 of the shorts garment portion 80 comprises a doeskin material 74, as shown in FIG. 1. The middle layer 30 comprises a laminate 75 of mesh fabric and foam. The outer, middle, and inner layers 20, 30, 40, respectively, are bonded with each adjacent layer so that there is no movement between the respective layers.

In the bib-shorts garment 120, the bib portion 121 further includes a bib second fabric portion 129 extending inside the mid-clavicular line 127 on a left 130 and a right 131 of the front 122 from the neck area 132 to the bib portion 121 at the waistline 128. The bib second fabric portion 129 includes a double-layer material having an inner layer of hydrophobic fibers and an outer layer of hydrophilic fibers. The bib first fabric portion 126 and the bib second fabric portion 129 can each include spandex.

In the bib-shorts garment 120 shown in FIG. 4, the shorts garment portion 80 includes a shorts second fabric portion 100 sewn to the shorts first fabric portion 90 extending from the waistline 128 downward to cover the majority of the inner thigh region 101 and laterally to the midline 102 of each leg 87 in the front 81 and back 82. The shorts second fabric portion 100 can include spandex. A shorts third fabric portion 110 is sewn to the shorts second fabric portion 100 extending from the waistline 128 to the bottom 111 of the legs 87 and from the shorts second fabric portion 100 laterally around the side 83 of each leg 87 to join the shorts second fabric portion 100 in both the front 81 and the back 82 of each leg 87. The shorts third fabric portion 110 can include spandex, preferably a heavier denier spandex than the spandex in the shorts second fabric portion 100.

In preferred embodiments of the bib-shorts garment 120, the first, second, and third shorts portions 90, 100, 110, respectively, are sewn together with over-edged seams and are pressed flat to minimize seam friction against the wearer's skin. In preferred embodiments, the shorts first fabric portion 90 is seamless in a bicycle seat contact region 112.

Embodiments of the present invention include a method of producing a multi-layered protective fabric 10 having enhanced moisture-management and cushioning properties. Such a method includes knitting an inside layer 50 of hydrophobic fibers, knitting an outside layer 60 of hydrophilic fibers, and knitting an intermediate layer 70 of hydrophobic monofilament yarns. The intermediate layer 70 of hydrophobic monofilament yarns 71 are attached to and extend a predetermined distance 61 between the inside layer 50 and the outside layer 60, defining a ventilation chamber between the inside and outside layers 50, 60, respectively. The combination of the inside layer, 50, the outside layer 60, and the intermediate layer 70 form an outer wicking layer 40. The method further includes bonding the outer wicking layer 40 to a porous middle cushioning layer 30, and bonding the middle cushioning layer 20 to an inner cushioning layer 20 that has a low friction coefficient.

In embodiments of such a method, the inside layer 50 and the outside layer 60 are each knit in a plane 73, and the hydrophobic monofilament yarns 71 are oriented in the same plane 73 and are substantially perpendicular to the inside layer 50 and the outside layer 60.

In other embodiments, the method can include adding a moisture-managing underlayer (not shown) disposed under the inner cushioning layer 20 of the multi-layered protective fabric 10 for placement next to the wearer's skin. In this configuration, moisture is wicked away from a wearer's skin and friction between the skin and the protective fabric is reduced. The underlayer can include a bottom layer of hydrophobic fibers and a top layer of hydrophilic fibers.

Although the present invention has been described with reference to particular embodiments, it should be recognized that these embodiments are merely illustrative of the principles of the present invention. Those of ordinary skill in the art will appreciate that a multi-layer protective fabric system and apparel incorporating such fabric systems of the present invention may be constructed and implemented in other ways and embodiments. Accordingly, the description herein should not be read as limiting the present invention, as other embodiments also fall within the scope of the present invention.

What is claimed is:

1. A shorts garment, comprising:

a front, a back, two sides, a waist, a torso region, a crotch region, and two legs extending from the torso region; and a shorts first fabric portion comprising a multi-layer protective fabric having an hour-glass shape extending from a middle of the front torso region through the crotch region to a middle of the back torso region;

the multi-layer protective fabric further comprising:

an inner layer comprising an abrasion-resistant material having a low friction coefficient;

a middle layer comprising a porous, cushioning material; and an outer wicking layer adapted for wicking moisture away from a wearer's skin, comprising:

an inside layer of hydrophobic material;

an outside layer of hydrophilic material spaced apart a predetermined distance from the inside layer; and an intermediate layer of monofilament hydrophobic yarns attached to and extending the predetermined distance between the inside layer and the outside layer, defining a ventilation chamber therebetween;

wherein the protective fabric cushions, removes moisture from, and reduces stress to the wearer's skin, and wherein moisture and heat are transferred from the wearer's skin by the inside layer and the intermediate layer to the outside layer where the moisture and heat are transferred to the atmosphere.

2. The shorts garment of claim 1, wherein the inner layer comprises a doeskin material.

3. The shorts garment of claim 1, wherein the middle layer comprises a laminate of mesh fabric and foam.

4. The shorts garment of claim 1, wherein the outer, middle, and inner layers are bonded with each adjacent layer so that there is no movement between the respective layers.

5. The shorts garment of claim 1, further comprising:

a shorts second fabric portion sewn to the shorts first fabric portion extending from the waist downward to cover the majority of an inner thigh region and laterally to a midline of each leg in the front and back, the second shorts fabric portion further comprising spandex; and a shorts third fabric portion sewn to the shorts second fabric portion extending from the waist to a bottom of the legs and from the shorts second fabric portion laterally around each side to join the shorts second fabric portion in both the front and back of each leg, the shorts third fabric portion further comprising a spandex.

6. The shorts garment of claim 5, wherein the first, second, and third shorts portions are sewn together with over-edged seams and are pressed flat to minimize seam friction against the wearer's skin.

7. The shorts garment of claim 1, wherein the shorts first fabric portion is seamless in a bicycle seat contact region.

* * * * *

UNITED STATES PATENT AND TRADEMARK OFFICE

CERTIFICATE OF CORRECTION

PATENT NO. : 6,918,140 B1
DATED : July 19, 2005
INVENTOR(S) : Shane Kevin Cooper It is certified that error appears in the above-identified patent and that said Letters Patent is hereby corrected as shown below:

Title page,
Item [56], References Cited, U.S. PATENT DOCUMENTS, add the following references:

| | | |
|---|---|---|
| -- 6,041,441 | 03/2000 | Counts et al. |
| 6,061,829 | 05/2000 | Gunn |
| 6,393,618 | 05/2002 | Garmeau |
| 6,401,250 | 06/2002 | McNabb |
| 6,511,927 | 01/2003 | Ellis et al. |
| 6,687,917 | 02/2004 | Forsyth et al. |
| US 2003/0056282 | 03/2003 | Coccia |
| US 2003/0226197 | 12/2003 | Cramer |
| US 2004/0143890 | 07/2004 | Reschewitz --. |

Signed and Sealed this

Thirtieth Day of August, 2005

JON W. DUDAS
*Director of the United States Patent and Trademark Office*